US006293075B1

(12) United States Patent
O'Connor et al.

(10) Patent No.: US 6,293,075 B1
(45) **Date of Patent: *Sep. 25, 2001**

(54) PACKAGING A STRIP OF MATERIAL

(75) Inventors: Lawrence J. O'Connor; Darrell Van Mol, both of Winnipeg (CA)

(73) Assignee: BKI Holding Corporation, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/263,889

(22) Filed: Mar. 8, 1999

(51) Int. Cl.[7] ..... B65B 13/20; B65B 31/04; B65B 61/20; B65B 63/04; B65B 61/24

(52) U.S. Cl. ..... 53/429; 53/117; 53/436; 53/527; 53/434; 53/445; 53/157; 206/494; 206/524.8; 270/39.03; 493/413

(58) Field of Search ..... 53/429, 116, 117, 53/434, 436, 445, 513, 520, 527, 135.1, 156, 157, 541; 206/494, 524.8; 493/413, 414, 415, 410, 411, 437, 439, 440, 357, 356, 363; 270/39.03

(56) References Cited

U.S. PATENT DOCUMENTS

| | | |
|---|---|---|
| 32,761 | 7/1861 | Elliot . |
| 1,029,459 | 6/1912 | Quigley . |
| 1,463,918 | 8/1923 | Borroughs . |
| 1,489,833 | 4/1924 | Keller . |
| 1,985,676 | 12/1934 | Hand . |
| 2,384,395 | 9/1945 | Payne . |
| 2,425,301 | 8/1947 | Browner . |
| 2,659,187 | 11/1953 | Barnes . |
| 3,245,680 | 4/1966 | Harrison et al. . |
| 3,285,405 | 11/1966 | Wanderer . |
| 3,321,889 | 5/1967 | Zubik et al. . |
| 3,351,992 | 11/1967 | Carter . |
| 3,429,095 | 2/1969 | Huson . |
| 3,499,261 | 3/1970 | Hullhorst et al. . |
| 3,627,306 | 12/1971 | Affupper . |
| 3,632,103 | 1/1972 | Nikitits . |

(List continued on next page.)

FOREIGN PATENT DOCUMENTS

| | | | |
|---|---|---|---|
| 181590 | | 4/1951 | (AT) . |
| 22983/83 | | 12/1983 | (AU) . |
| 1 141 610 | | 11/1954 | (DE) . |
| 1 141 610 | | 12/1962 | (DE) . |
| 2 225 061 | | 5/1972 | (DE) . |
| 0 274 737 | | 12/1987 | (EP) . |
| 0 383 501 | | 2/1990 | (EP) . |
| 1.357.816 | | 7/1964 | (FR) . |
| 883100 | | 12/1958 | (GB) . |
| 2 028 774 | | 3/1980 | (GB) . |
| 2 193 734 | | 2/1988 | (GB) . |
| 57-47638 | * | 3/1982 | (JP) ..... 53/116 |
| 63-176257 | | 7/1988 | (JP) . |
| 2-182666 | | 7/1990 | (JP) . |
| 2678390 | | 8/1997 | (JP) . |

(List continued on next page.)

OTHER PUBLICATIONS

Ambrosky Article entitled "Alternative Means of Packing Airlaid Webs—Spooling & Festooning Pads" pp. 1–12.

*Primary Examiner*—Stephen F. Gerrity
(74) *Attorney, Agent, or Firm*—Darby & Darby

(57) ABSTRACT

A method is provided for forming a package of a plurality of side-by-side stacks of continuous strips of material without intervening rigid container walls. Each strip is folded back and forth about first and second fold lines to form a stack of a plurality of folded overlying strip portions. The fold lines are transverse to the strip and arranged at opposite ends of the stack. The strip portions of each stack are arranged side-by-side so that the side edges are aligned. The strips are fed simultaneously through a guide slot in a movable carriage that is parallel to the stacks end upon which the stacks are arranged.

16 Claims, 10 Drawing Sheets

U.S. PATENT DOCUMENTS

| | | |
|---|---|---|
| 3,645,759 | 2/1972 | Heiligman . |
| 3,673,757 | 7/1972 | Willis . |
| 3,684,275 | 8/1972 | Schweitzer et al. . |
| 3,697,062 | 10/1972 | Mones et al. . |
| 3,729,367 | 4/1973 | Shore et al. . |
| 3,739,544 | 6/1973 | Hanemann . |
| 3,780,908 | 12/1973 | Fitzpatrick et al. . |
| 3,913,904 | 10/1975 | Occhetti . |
| 3,972,519 | 8/1976 | Melzer . |
| 4,053,151 | 10/1977 | Frezza . |
| 4,074,901 | 2/1978 | Catallo . |
| 4,097,039 | 6/1978 | Fischer . |
| 4,130,679 | 12/1978 | Breznak et al. . |
| 4,174,101 | 11/1979 | Frezza . |
| 4,201,029 | 5/1980 | Lerner et al. . |
| 4,240,854 | 12/1980 | Massey et al. . |
| 4,332,583 | 6/1982 | Stemmler et al. . |
| 4,406,650 | 9/1983 | Felix . |
| 4,408,666 | 10/1983 | Lawson . |
| 4,418,514 | 12/1983 | Spann . |
| 4,427,404 | 1/1984 | Yamada . |
| 4,460,291 | 7/1984 | Lamendour . |
| 4,467,589 | 8/1984 | van Maanen . |
| 4,488,833 | 12/1984 | Perry et al. . |
| 4,493,689 | 1/1985 | Affupper . |
| 4,499,707 | 2/1985 | Desjobert et al. . |
| 4,512,464 | 4/1985 | Sylvester . |
| 4,544,304 | 10/1985 | Fisher . |
| 4,547,184 | 10/1985 | Bunch, Jr. . |
| 4,564,184 | 1/1986 | Rumpel . |
| 4,573,670 | 3/1986 | Felix . |
| 4,597,748 | 7/1986 | Wolf . |
| 4,603,817 | 8/1986 | O'Connor . |
| 4,670,001 | 6/1987 | Campbell et al. . |
| 4,715,925 | 12/1987 | Hofmeister et al. . |
| 4,716,706 | 1/1988 | Boeckmann . |
| 4,730,762 | 3/1988 | Felix . |
| 4,737,045 | 4/1988 | Koefferlein . |
| 4,815,405 | 3/1989 | Young, Jr. . |
| 4,824,426 | 4/1989 | DuFresne . |
| 4,828,540 | 5/1989 | Fordyce . |
| 4,829,918 | 5/1989 | Young, Jr. . |
| 4,846,454 | 7/1989 | Parkander . |
| 4,863,029 | 9/1989 | Koskol et al. . |
| 4,907,397 | 3/1990 | Goodman . |
| 4,941,374 | 7/1990 | Focke . |
| 5,029,828 | 7/1991 | Sato et al. . |
| 5,036,977 | 8/1991 | Schofield et al. . |
| 5,041,074 | 8/1991 | Zwimpfer . |
| 5,042,789 | 8/1991 | Hediger . |
| 5,047,003 | 9/1991 | Schmidlin et al. . |
| 5,064,179 | 11/1991 | Martin . |
| 5,085,624 | 2/1992 | Felix . |
| 5,087,140 | 2/1992 | Keeton et al. . |
| 5,104,366 | 4/1992 | Bunch . |
| 5,147,273 | 9/1992 | Rottmann et al. . |
| 5,177,934 | 1/1993 | Yamamoto . |
| 5,201,700 | 4/1993 | Meschi . |
| 5,205,808 | 4/1993 | Gebhardt . |
| 5,242,057 | 9/1993 | Cook et al. . |
| 5,290,226 | 3/1994 | Green, Jr. . |
| 5,348,527 | 9/1994 | Beckwith . |
| 5,358,140 | 10/1994 | Pellegrino . |
| 5,529,564 | 6/1996 | Hediger . |
| 5,558,318 | 9/1996 | Crowley et al. . |
| 5,616,113 | 4/1997 | Van Den Bergh . |
| 5,658,638 | 8/1997 | Pottenger . |
| 5,690,250 | 11/1997 | Gooding, Jr. et al. . |
| 5,730,695 | 3/1998 | Hauschild et al. . |
| 5,987,851 * | 11/1999 | P'Connor ..... 53/429 |

FOREIGN PATENT DOCUMENTS

| | | |
|---|---|---|
| 155205 | 8/1987 | (SU) . |
| 1555-205 | 4/1990 | (SU) . |
| WO 98/58864 | 12/1998 | (WO) . |
| 99/35073 | 7/1999 | (WO) . |

* cited by examiner

PACKAGING A STRIP OF MATERIAL

This invention relates to a method for forming a strip of material and to a product formed from the strip.

This application is related to applications on this subject matter as follows:

Ser. No. 08/876,402 filed Jun. 16, 1997, now U.S. Pat. No. 5,921,064 issued Jul. 13, 1999;

Ser. No. 08/878,826 filed Jun. 19, 1997, now U.S. Pat. No. 6,035,608 issued Mar. 14, 2000;

Ser. No. 08/906,291 filed Aug. 5, 1997, now abandoned;

Ser. No. 08/939,815 filed Sep. 29, 1997, now U.S. Pat. No. 5,956,926 issued Sep. 28, 1999;

Ser. No. 08/939,444 filed Sep. 29, 1997, now abandoned;

Ser. No. 08/939,881 filed Sep. 29, 1997, now abandoned;

Ser. No. 08/948,258 filed Oct. 9, 1997, now abandoned;

Ser. No. 08/889,737 filed Jul. 8, 1997, now U.S. Pat. No. 5,927,051 issued Jul. 27, 1999; and Ser. No. 09/081,826 filed May 20, 1998, now U.S. Pat. No. 5,987,851 issued Nov. 23, 1999.

The disclosure of all of the above applications is incorporated herein by reference and is also published on Dec. 30, 1998 in International application No. PCT/CA98/00592 publication No. 98/58864.

BACKGROUND OF THE INVENTION

Previously packages of a continuous strip of material have been formed using a technique known as "festooning" in which the strip is folded back and forth to lay a series of strip portions back and forth with each portion being folded relative to the next about a line transverse to the strip. The technique of festooning has been available for many years and is used in packaging many different types of material but particularly material of a fibrous nature such as fabric, non-woven strips and the like. In this technique, the strip is conventionally guided into a receptacle such as a cardboard box while a first reciprocating movement causes portions of the strip to be laid across the receptacle and folded back and forth and a second reciprocating movement causes the positions of the portions to be traversed relative to the receptacle transversely to the portions. Normally the receptacle comprises a rigid rectangular container at least partly of cardboard having a base and four upstanding sides.

In an alternative arrangement the strip is packaged by rolling the strip into a cylindrical pad having a width equal to the width of the strip or is wound into a cylindrical traverse package having a width greater than the width of the strip.

In all of these arrangements, the intention is to limit the number of splices in the strip since these slices cause the material at or on either side of the splice to be scrapped. Splices are necessary in joining the master rolls from which the strips are slit The above applications disclose details of an improved method of forming a package of a strip for supply of the strip comprising:

providing a strip having a first side edge, a second side edge, a first surface and a second surface;

forming a plurality of stacks of the strip;

in each of the stacks repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions thus to form a plurality of first fold lines at one end of the stack and a plurality of second fold lines at an opposed end of the stack;

arranging the strip portions thus such that the first surface of each strip portion lies directly in contact with the first surface of one next adjacent portion and such that the second surface of each portion lies directly in contact with the second surface of the other next adjacent portion;

arranging the strip portions with the first side edges thereof lying directly on top of and aligned with the first side edges of others of the strip portions of the stack and with the second side edges thereof lying directly on top of and aligned with the second side edges of others of the strip portions;

arranging the strip portions of the stack with the first and second surfaces thereof generally parallel to a top surface and bottom surface of the stack;

arranging the strip so as to be continuous through the stack between a bottom strip portion and a top strip portion;

arranging the stacks side by side without intervening rigid container walls;

and providing at the top and bottom of each stack a tail portion of the strip which is available for splicing to the tail portion of the strip of the next adjacent stack.

In most cases the entire top surface and the entire bottom surface of each of the stacks are placed under compression in a direction at right angles to the top surface and the bottom surface of the stack and the package is engaged by a packaging material which maintains the compression.

One problem which arises in the manufacture of a package of this type is in simultaneously folding the strips side by side to form simultaneously the side by side stacks of the finished package. For economic production, it is highly desirable that the folding is effected at a relatively high rate generally greater than 500 feet per minute, preferably of the order of 750 feet per minute and even up to 1200 feet per minute at which some lines currently operate. These higher rates allows the folding machine to be provided directly behind the manufacturing line thus avoiding necessity for packaging the material in web form prior to manufacture of the package of the type set forth above.

One arrangement for folding paper sheet into a single stack of zig zag folded sheet portion is shown in U.S. Pat. No. 4,573,670 (Felix) assigned to Jos. Hunkeler AG of Switzerland. Later U.S. Pat. Nos. 5,085,624 (Felix) and 5,042,789 (Hediger) are also relevant to this machine.

In this machine there is provided a carriage which moves horizontally back and forth underneath a stack of the sheets of paper. The carriage defines a transverse slot which is moved back and forth underneath the stack so that a supply of the paper sheet fed from beneath the stack through the slot is folded back and forth as the slot is moved back and forth under the package.

The package is supported on two belts each of which wraps around a respective one of a pair of rollers defining a slot. The upper run of each of the belts is thus in effect stationary holding and supporting the package in stationary position as the slot defined by the belts in the roller is moved back and forth. This arrangement as shown in the patents has led to a successful machine which folds paper sheet into a single stack at a relatively slow speed.

This machine is however unsuitable for and has not been in any way used for the manufacture of packages defined by a plurality of side by side stacks of strip material of relatively narrow width.

SUMMARY OF THE INVENTION

It is one object of the present invention, therefore, to provide an improved arrangement for forming a package of the type generally described above.

According to a first aspect of the invention there is provided a method of forming a package of a strip comprising:

providing a strip having a first side edge, a second side edge, a first surface and a second surface;

forming a plurality of stacks of the strip;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack, with the strip of each stack continuous through the stack between a bottom strip portion and a top strip portion;

and arranging the plurality of stacks side by side with the side edges of the strip portions of each stack adjacent the side edges of a next adjacent stack;

wherein the step of folding the strip in the stacks includes:

simultaneously supplying the strips side by side;

feeding the side by side strips through a guide slot in a carriage moveable parallel to the bottom surface of the stacks and moving the slot back and forth between the ends of the stacks so as to form the stacks on top of the carriage;

and providing guide surfaces engaging side edges of two outermost stacks of the package to maintain the stacks parallel and side by side.

Preferably the material is carried from a supply to the slot through a guide chute which has one end which is pivotal at the supply and a second end which reciprocates with the guide slot and which has a length between the ends which changes in response to reciprocation of the slot.

According to a second aspect of the invention there is provided a method of forming a package of a strip comprising:

providing a strip having a first side edge, a second side edge, a first surface and a second surface;

forming a plurality of stacks of the strip;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack, with the strip of each stack continuous through the stack between a bottom strip portion and a top strip portion;

arranging the plurality of stacks side by side with the side edges of the strip portions of each stack adjacent the side edges of a next adjacent stack;

wherein the step of folding the strip in the stacks includes:

simultaneously supplying the strips side by side;

feeding the side by side strips through a guide slot in a carriage moveable parallel to the bottom surface of the stacks and moving the slot back and forth between the ends of the stacks so as to form the stacks on top of the carriage;

providing a bag for receiving the side by side stacks, the bag having an open mouth and side walls;

and supporting the bag with the open mouth facing the carriage such that as the stacks are formed the stacks are forced into the open mouth to engage and be surrounded by the side walls of the bag to be received within the bag.

Preferably the method includes, after the stacks are formed and partly contained within the bag, compressing the stacks in a direction to reduce the height thereof to a position in which the stacks are wholly contained within the bag.

Preferably the bag has a length which is equal to the compressed height of the stacks.

Preferably the method includes providing a bottom sheet underlying the bottom surface of the stacks and including providing the bag with a closed upper end and an open bottom edge of the bag which is attached to the sheet to form a closed enclosure for the package.

Preferably the method includes evacuating the enclosure.

According to a third aspect of the invention there is provided a method of forming a package of a strip comprising:

providing a strip having a first side edge, a second side edge, a first surface and a second surface;

forming a plurality of stacks of the strip;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying. directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack, with the strip of each stack continuous through the stack between a bottom strip portion and a top strip portion;

arranging the plurality of stacks side by side with the side edges of the strip portions of each stack adjacent the side edges of a next adjacent stack;

compressing the stacks in a direction at right angles to the top and bottom surfaces so as to reduce the height of the stacks from a rest height to a compressed height;

and containing the compressed stacks in an enclosure so as to maintain the compression thereon, the enclosure comprising a bag having side walls with a length thereof substantially equal to the compressed height.

Preferably the enclosure comprises a bottom sheet underlying the bottom surface of the stacks and including providing the bag with a closed upper end and an open bottom edge of the bag which is attached to the sheet.

According to a fourth aspect of the invention there is provided a method of forming a package of a strip comprising:

providing a strip having a first side edge, a second side edge, a first surface and a second surface;

forming a plurality of stacks of the strip;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line, arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack, with the strip of each stack continuous through the stack between a bottom strip portion and a top strip portion;

arranging the plurality of stacks side by side with the side edges of the strip portions of each stack adjacent the side edges of a next adjacent stack;

wherein the step of folding the strip in the stacks includes:

simultaneously supplying the strips side by side;

feeding the side by side strips through a guide slot in a carriage moveable parallel to the bottom surface of the stacks and moving the slot back and forth between the ends of the stacks so as to build the stacks on top of the carriage;

at a predetermined location during building of the stacks, feeding with the strips into the stacks a flexible slip sheet so to be folded with the strips at the predetermined location;

and when the stacks are built up to a required height above said location, pushing those portions of the stacks above said location toward one end of the stacks such that the portions above said location are separated from portions below said location by slipping of the strips across the slip sheet.

Preferably the slip sheet has a length at least equal to the length of the strip portions.

Preferably the slip sheet is folded across its width to provide two overlying slip sheet portions.

According to a fifth aspect of the invention there is provided a method of forming a package of a strip comprising:

providing a strip having a first side edge, a second side edge, a first surface and a second surface;

forming a plurality of stacks of the strip;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack, with the strip of each stack continuous through the stack between a bottom strip portion and a top strip portion;

and arranging the plurality of stacks side by side with the side edges of the strip portions of each stack adjacent the side edges of a next adjacent stack;

providing for each of the stacks a splice tail portion extending from the bottom strip portion and extending beyond an end of the stack so as to be accessible for splicing;

all of the splice tail portions being arranged at the same end of the stacks;

engaging the splice tail portions into an envelope;

lying the envelope flat against said end of the stacks and containing the envelope within packaging material.

Preferably each stack has an upper free tail portion which is arranged at the same end of the package as the splice tail portions.

Preferably the upper free tail portion depends down the end of the package from the top strip portion so as to be accessible for splicing to the splice tail portion.

According to a sixth aspect of the invention there is provided a method of providing a strip comprising:

providing a package comprising:

a strip having a first side edge, a second side edge, a first surface and a second surface;

a plurality of stacks of the strip;

in each stack the strip being repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions of each stack being arranged to form a plurality of first fold lines at one end of the stack and a plurality of second fold lines at an opposed end of the stack;

the strip portions of each stack being arranged such that the first surface of each strip portion lies directly in contact with the first surface of one next adjacent strip portion and such that the second surface of each strip portion lies directly in contact with the second surface of the other next adjacent strip portion;

the strip portions of each stack being arranged with the first side edges thereof lying directly on top of and aligned with the first side edges of others of the strip portions of the stack and with the second side edges thereof lying directly on top of and aligned with the second side edges of others of the strip portions of the stack;

the strip portions of each stack being arranged with the first and second surfaces thereof generally parallel to a top surface and a bottom surface of the stacks with the strip of each stack continuous through the stack between a bottom strip portion and a top strip portion;

the plurality of stacks being arranged side by side with the side edges of the strip portions of each stack adjacent the side edges of a next adjacent stack;

the stacks being compressed in a direction at right angles to the surfaces of the strip portions such that the height of the stacks is reduced from a rest height to a compressed height;

the package being wrapped and maintained compressed by a packaging enclosure including a bag having a side wall substantially equal in height to the compressed height and therefore less than the rest height;

mounting the package on an unfolding stand such that the bottom surface of the stacks is supported on the stand and the upper surfaces of the stacks are presented upwardly;

providing on the unfold stand a header member for engaging the upper surfaces;

with the upper surfaces engaged by the header member to hold the compression, cutting open the bag;

and moving the header member in a direction to allow controlled expansion of the stacks from the compressed condition to the rest condition.

According to a seventh aspect of the invention there is provided a method of providing a strip comprising:

providing a package comprising:

a strip having a first side edge, a second side edge, a first surface and a second surface;

a plurality of stacks of the strip;

in each stack the strip being folded repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions of each stack being arranged to form a plurality of first fold lines at one end of the stack and a plurality of second fold lines at an opposed end of the stack;

the strip portions of each stack being arranged such that the first surface of each strip portion lies directly in contact with the first surface of one next adjacent strip portion and such that the second surface of each strip portion lies directly in contact with the second surface of the other next adjacent strip portion;

the strip portions of each stack being arranged with the first side edges thereof lying directly on top of and aligned with the first side edges of others of the strip portions of the stack and with the second side edges thereof lying directly on top of and aligned with the second side edges of others of the strip portions of the stack;

the strip portions of each stack being arranged with the first and second surfaces thereof generally parallel to a top surface and a bottom surface of the stack, with the strip of each stack continuous through the stack between a bottom strip portion and a top strip portion;

the plurality of stacks being arranged side by side with the side edges of the strip portions of each stack adjacent the side edges of a next adjacent stack;

providing for each of the stacks a splice tail portion extending from the bottom strip portion and extending beyond an end of the stack so as to accessible for splicing;

all of the splice tail portions being arranged at the same end of the stacks;

mounting the package on an unfolding stand such that the bottom surface of the stacks is supported on the stand and the upper surfaces of the stacks are presented upwardly;

providing on the unfold stand a splicing jig;

engaging the splice tail portions with the splicing jig so as to be supported thereby;

providing a top end portion of each stack connected to the top of the respective stack and engaging the top end portions with the splicing jig so as to be supported thereby;

and operating the splicing jig to effect splicing of the splice tail portions to the top end portions such that the strip is continuous through the package.

Preferably the method includes engaging the splice tail portions into an envelope lying against said end of the stacks and contained within packaging material.

Preferably each top end portion is arranged at the same end of the package as the splice tail portions.

Preferably the top end portion depends down the end of the package from the top strip portion so as to be accessible for splicing to the splice tail portion.

According to an eighth aspect of the invention there is provided a package comprising:

a strip having a first side edge, a second side edge, a first surface and a second surface;

a plurality of stacks of the strip;

in each stack the strip being folded repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions of each stack being arranged to form a plurality of first fold lines at one end of the stack and a plurality of second fold lines at an opposed end of the stack;

the strip portions of each stack being arranged such that the first surface of each strip portion lies directly in contact with the first surface of one next adjacent strip portion and such that the second surface of each strip portion lies directly in contact with the second surface of the other next adjacent strip portion;

the strip portions of each stack being arranged with the first side edges thereof lying directly on top of and aligned with the first side edges of others of the strip portions of the stack and with the second side edges thereof lying directly on top of and aligned with the second side edges of others of the strip portions of the stack;

the strip portions of each stack being arranged with the first and second surfaces thereof generally parallel to a top surface and a bottom surface of the stack, with the strip of each stack continuous through the stack between a bottom strip portion and a top strip portion;

the plurality of stacks being arranged side by side with the side edges of the strip portions of each stack adjacent the side edges of a next adjacent stack;

the stacks being compressed in a direction at right angles to the surfaces of the strip portions such that the height of the stacks is reduced from a rest height to a compressed height;

the package being wrapped and maintained compressed by a packaging enclosure including a bag having a side wall substantially equal in height to the compressed height and therefore less than the rest height.

Preferably each of the stacks includes a splice tail portion extending from the bottom strip portion and extending beyond an end of the stack so as to accessible for splicing, all of the splice tail portions being arranged at the same end of the stacks, the splice tail portions being engaged into an envelope lying flat against said end of the stacks and contained within the bag.

Preferably the enclosure comprises a bottom sheet underlying the bottom surface of the stacks and wherein the bag includes a closed upper end and an open bottom edge of the bag which is attached to the sheet.

Preferably the bottom sheet includes side edges thereof which are turned upwardly and heat sealed to bottom edge portions of the bag.

Preferably the bag and the sheet each comprise a laminate defined by a first layer of an air impervious plastics material and a second layer of a heat sealable plastics material.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

The structure of the package with which the present invention is concerned is shown in more detail in the above mentioned applications including the published International application defined above. Reference is made therefore to those documents for further details of the package structure which may be necessary for full understanding of the following.

Figure 8:
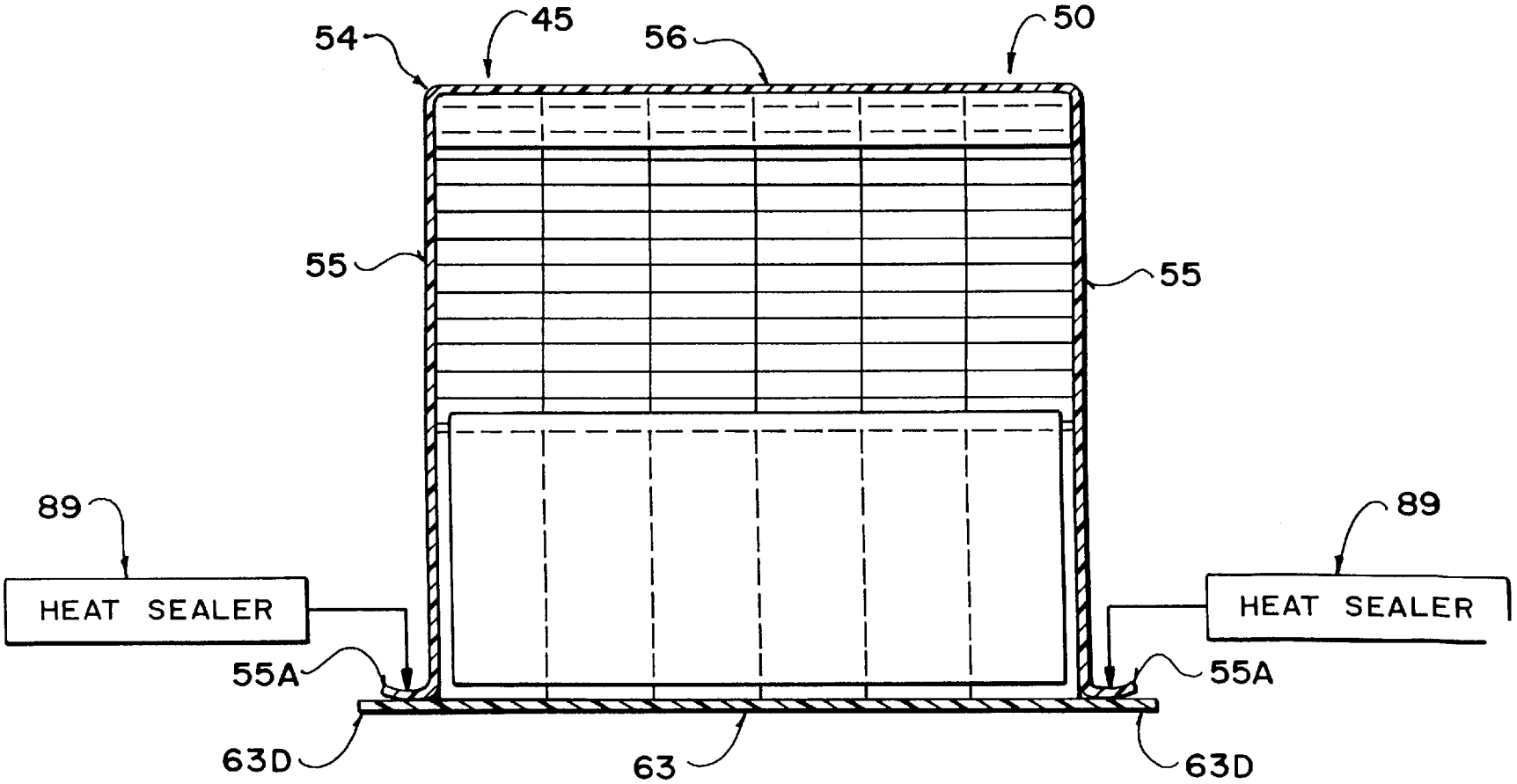
FIG. 8 is a view similar to that of FIG. 7 showing the package after compression in the compression station and after sealing of the enclosure.
Figure 9:
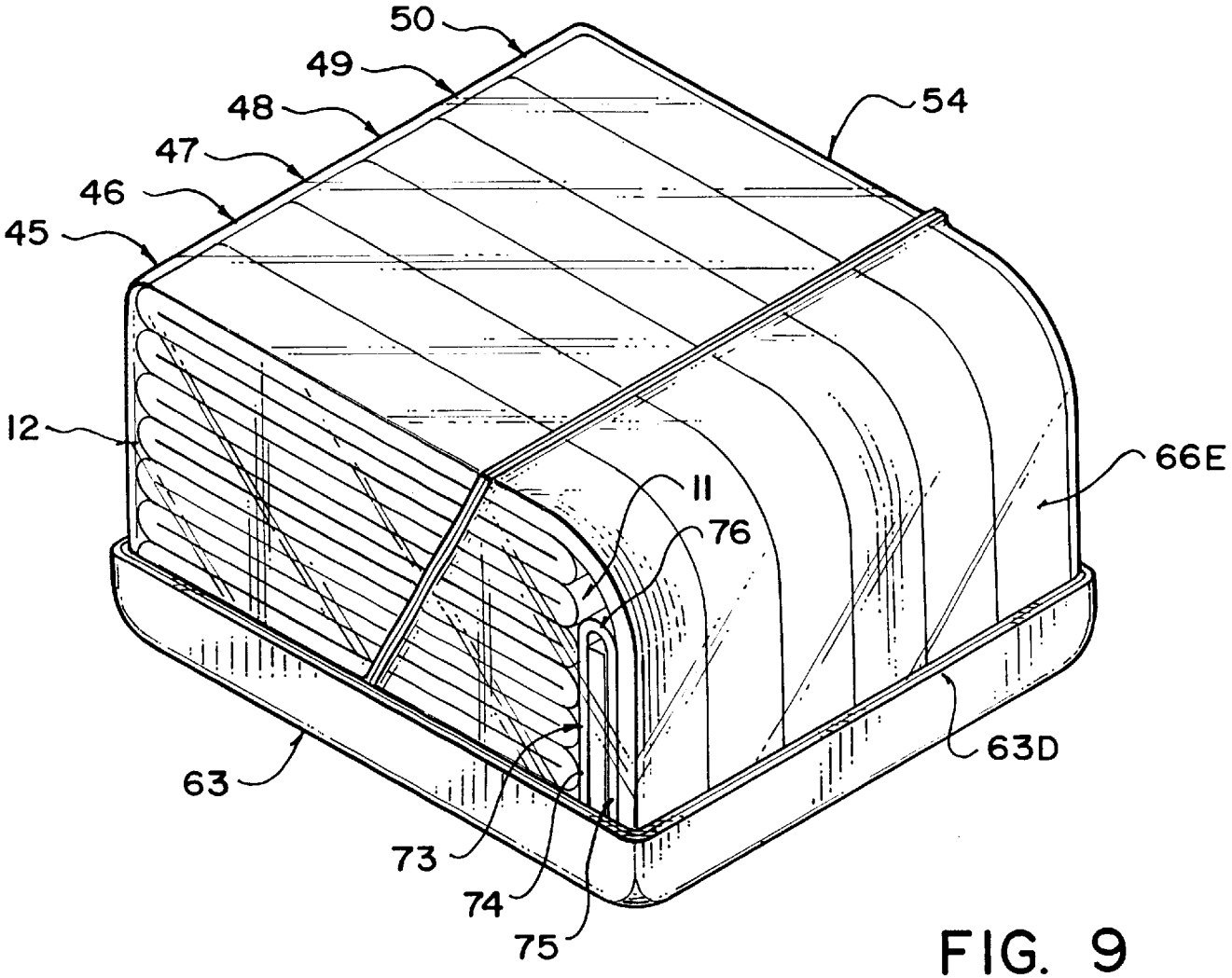
FIG. 9 is an isometric view showing the package after compression in the compression station and after sealing of the enclosure.
Figure 12:
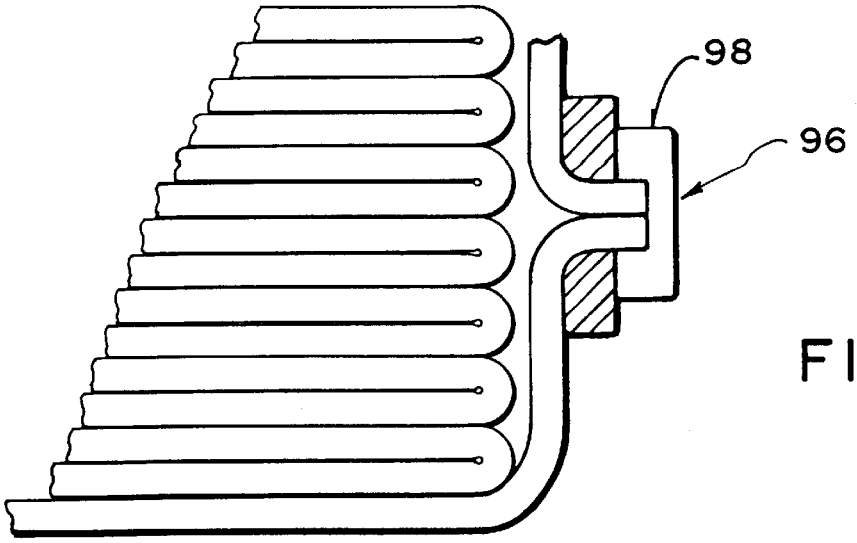
FIG. 12 is a schematic cross-sectional view showing a typical splicing jig.
Figure 10:
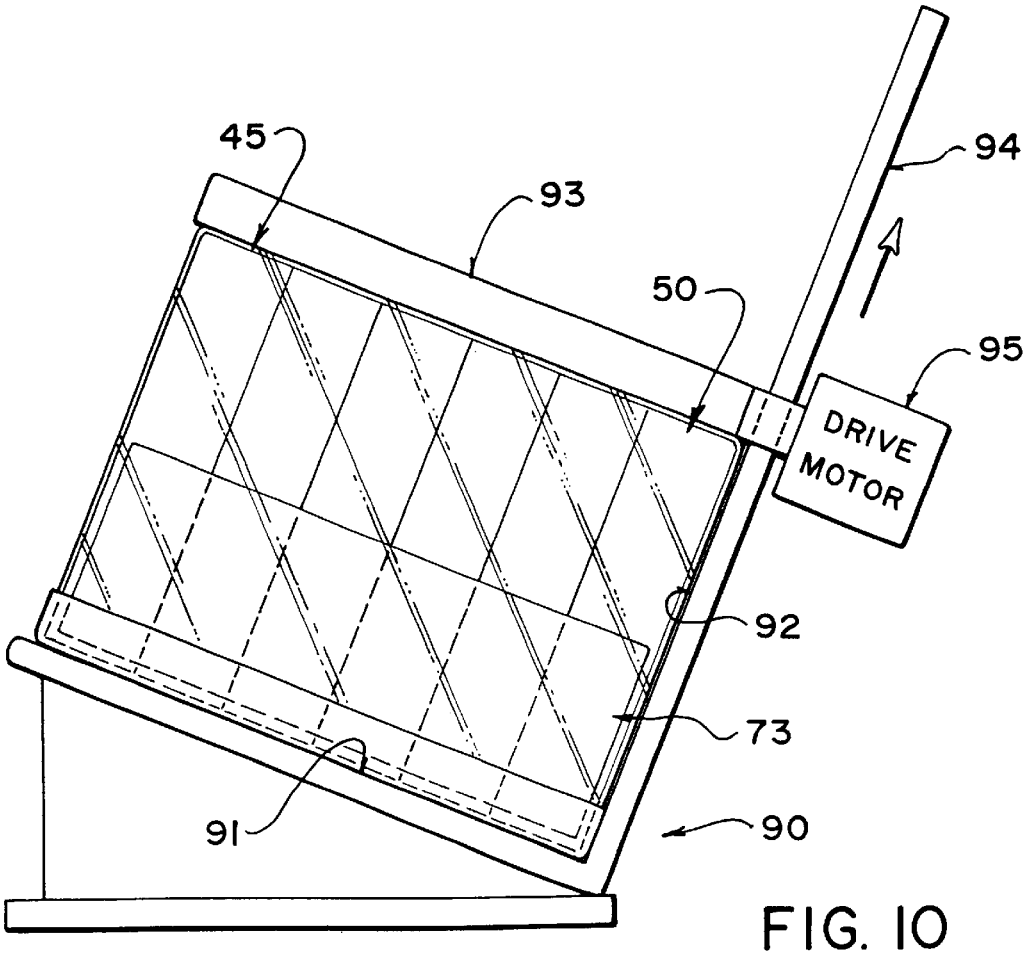
FIG. 10 is side elevational view showing the package of FIG. 9 in an unfolding stand prior to opening of the package for pay-off of the strip.
Figure 11:
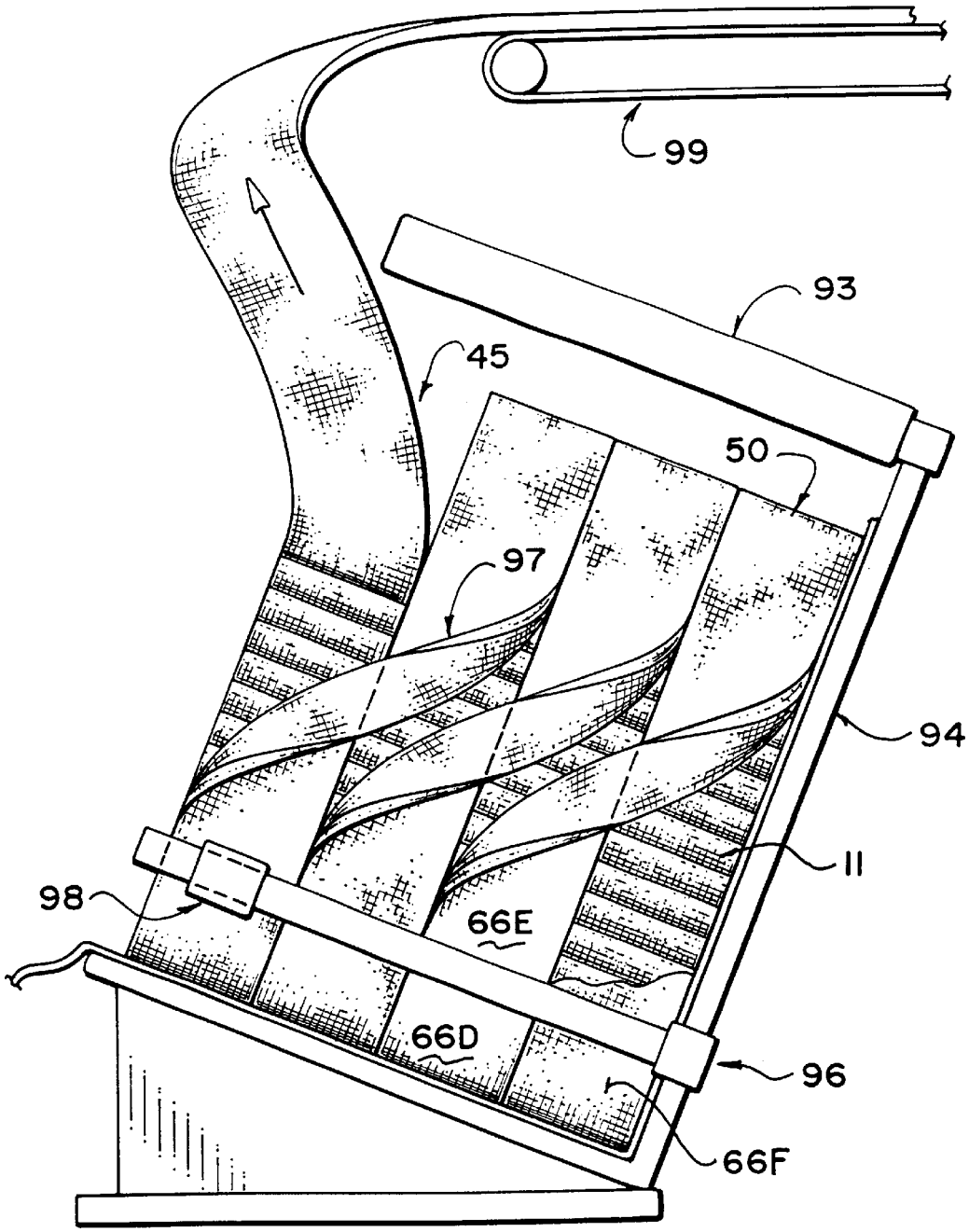
FIG. 11 is side elevational view showing the package of FIG. 9 in the unfolding stand during pay-off of the strip.

The present invention is concerned with the machine for forming the package which is shown in FIGS. 1 through 9 together with the unfolding stand of FIGS. 10, 11 and 12 which allows the package formed in the machine to be properly controlled and handled during the unfolding process.

Figure 1:
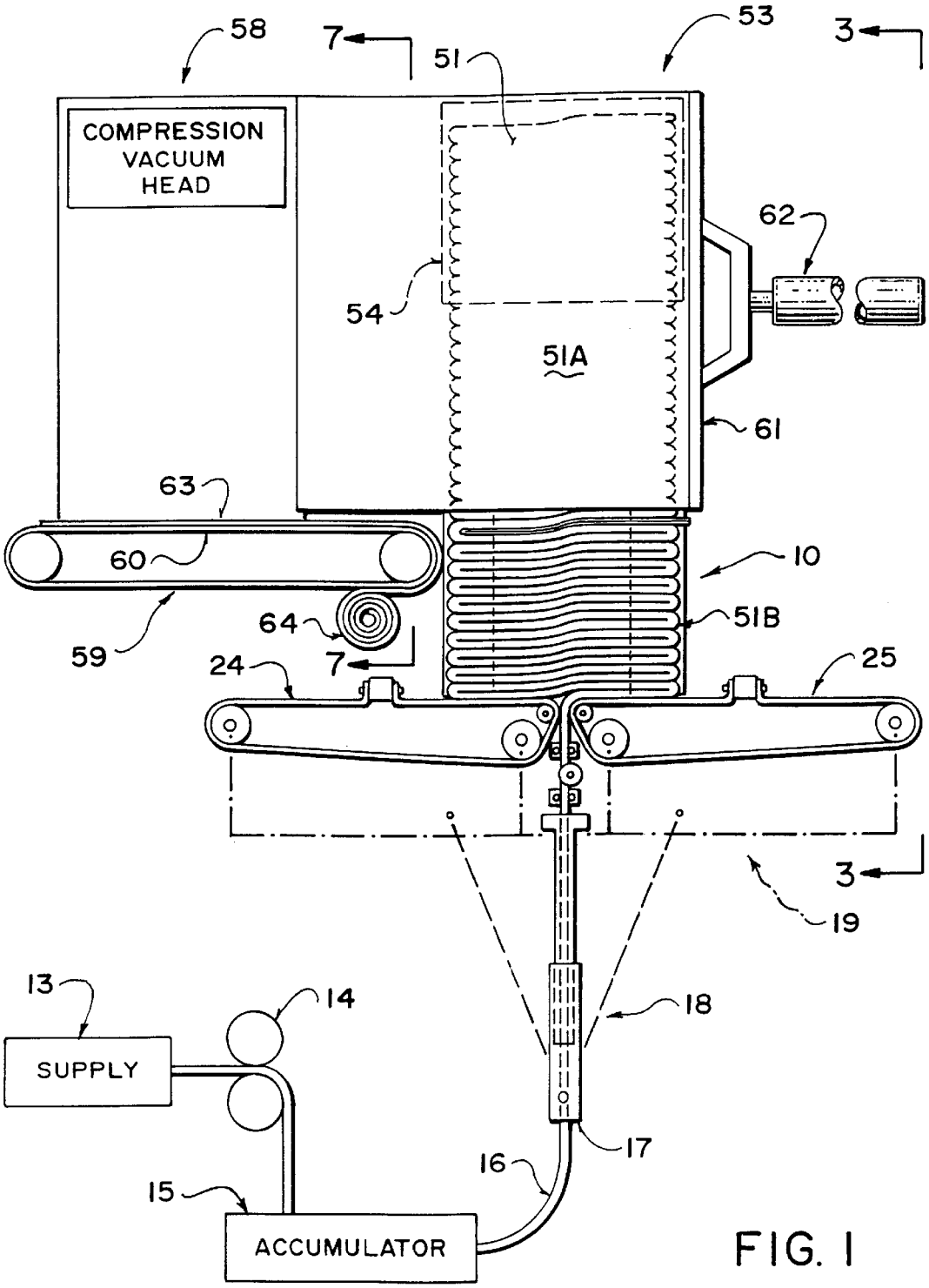
FIG. 1 is a side elevational view of a process of forming a package of a strip according to the present invention.
Figure 2:
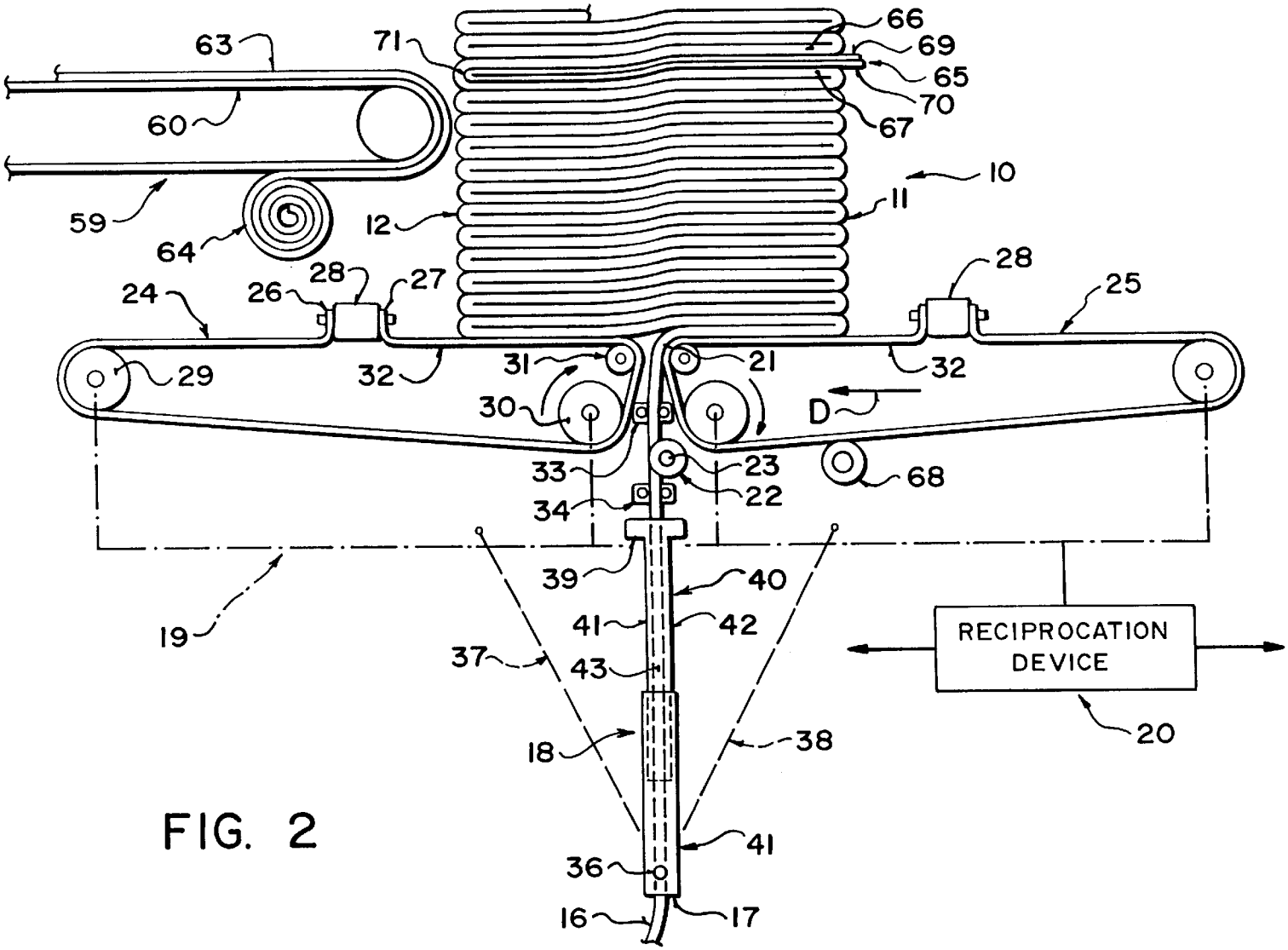
FIG. 2 is a similar view to that of FIG. 1 showing a portion of the process on an enlarged scale.

Turning now to FIG. 1 there is shown a package structure 10 formed by a plurality of side by side stacks of the strip material. Each stack is formed as best shown in FIG. 2 by zig zag folding of the strip back and forth between fold lines 11 and 12 to form overlying portions of the strip. The strip is folded so that each portion lies directly on top of the previous portion with the side edges thereof aligned. The length of the portions is constant so that the stack defines ends containing fold lines which are vertical and parallel.

The material defined in the strips is forwarded from a supply 13. This supply can be direct from a manufacturing line without any intervening winding or rolling of a web or can be in other situations a roll of web of the material.

The supply is forwarded through a driven forwarding system 14 into an accumulator 15 or dancer arrangement which acts to temporarily accumulate the material since the supply is generally forwarded at constant speed while the folding action varies in speed in view of the reciprocating action described hereinafter.

From the accumulator the material in a width approximately equal to the width of the package is fed as a sheet 16 into a mouth 17 at the bottom of a rectangular duct 1 8 through which the sheet or web of the material passes.

The material carried through the duct is transported to a carriage generally indicated at 19 which is reciprocated back and forth by a drive device schematically indicated at 20. The carriage 19 in effect defines a slot 21 which is carried by the carriage back and forth underneath the stacks 10 so that the strip material is fed through the slot 21 and is carried by the slot back and forth between the fold lines 11 and 12 to define the folded strip portions.

In one alternative arrangement, the web of material is slit into individual strips in the supply 13 and thus is supplied through the accumulator and into the chute 18 in the form of side by side individual strips. In this arrangement, it may be desirable to provide two separate supplies in which the strips are arranged alternately in a first supply and a second supply then brought together in the side by side arrangement prior to entering the duct 18 so the strips are properly guided side by side without the possibility of any overlap.

In a second alternative and preferred arrangement illustrated in FIG. 2, the material from the supply 13 is instead in web width without being slit into individual strips. In this arrangement the web is slit by a plurality of slitting blades 22 into the individual strips side by side. The blades 22 are of the disc type mounted on a rotary shaft 23 driving the blades in a rotary action so as to provide an accurate slitting effect. The blades are arranged at spaced positions along the length of the shaft with a shaft extending across the width of the web, the spacing being selected to provide the required width of the individual strips. The blades will also act to trim each edge of the material in conventional manner so that the finished width of the package is less than the feed width of the material.

The slot 21 is defined between a pair of belts 24 and 25. Each belt has ends 26, 27 attached to a fixed mounting block 28 which remains stationary during the folding action.

Each belt is wrapped around a first end support roller 29 and a second end support roller 30. At the roller 30 is provided a second smaller support roller 31 so that the rollers 30 and 31 co-operate to support one end of the belt. The rollers 30 and 31 at one end and the roller 29 at the other end of the belt thus cooperate in holding the belt in tension stretched on either side of the block 28.

The rollers 29, 30 and 31 are carried on the carriage 19 in fixed position on the carriage so that they reciprocate with the carriage back and forth.

The roller 31 is relatively small in comparison with the roller 30 and is positioned above the roller 30. Thus the rollers 31 of the two belts 24 and 25 are arranged closer together than the rollers 30 so that the two belts converge together from a wider mouth wrapped around the rollers 30 to a narrower position at the slot 21 defined between the rollers 31.

The carriage can include further support plates supporting the upper run 32 of the belts between the block 28 and the slot roller 31. The rollers 30 and 31 are supported on the carriage by mechanical supports which allow the rollers to support the belts and thus to support the package as it is formed on top of the carriage.

Thus as the carriage reciprocates back and forth, the slot between the slot rollers 31 is moved firstly toward the left as indicated at arrow D so that the portion 32 of the belt 24 decreases in length as the roller 31 moves toward the block 28. At the same time the portion 32 of the belt 25 between the roller 31 and the block 28 increases in length. However the belt portions in effect remain stationary and act to support the underside of the package 10 which also remains stationary relative to the movement of the belt and the blocks 28.

The slot is thus moved to the fold lines 12 where the movement of the carriage is reversed to a direction opposite to the arrow D thus carrying the strip back from the fold lines 12 toward the fold lines 11.

The rollers 31 rotate in the same direction at all times. As the carriage 19 is reciprocated, the direction of the rollers reverses at each end of the reciprocating movement.

Thus while the carriage is moving in a direction D, the rollers 31 rotate in a clockwise direction and while the carriage moves in the direction opposite to arrow D, the rollers rotate in a counter clockwise direction. Thus at all times, one of the rollers acts to feed the strip through the slot while the other is rotating in a direction opposite to the feed direction. The slot is therefore slightly wider than the thickness of the strip material since the strip material cannot be nipped between the rollers. The rollers thus alternately act to feed the material and to carry the material onto the top of the belt run as shown in FIG. 2, where the strip material is carried over the roller 31 of the belt 25 and deposited onto the upper run 32 of the belt 25.

The provision of the smaller rollers 31 acts to allow the belts to come together sufficiently to enclose the strip material without nipping the strip material.

A one way brake arrangement 33 is provided in the neck area between the rollers 30 and immediately below the slot 21 so as to allow the strip material to feed forwardly while preventing any reverse movement of the strip material. This one way brake arrangement ensures that the strip is fed positively through the slot and is prevented from slipping back through the slot at the fold lines where there is a tendency for reverse movement to occur. In between the fold lines, it will be appreciated that the strip material is carried over that roller which is rotating in the required feed direction and is deposited on to the top of the belt in a positive feeding action.

In the arrangement previously described where slitting occurs prior to the chute 18, only a single brake 33 is required immediately upstream of the slot 21.

In the alternative arrangement as shown including the slitting discs 22, there is preferably provided a second one way brake arrangement 34 located upstream of the slitting discs so that the slitting discs are carried between the brakes 33 and 34 thus maintaining tension across the strip as it is being slit.

The chute 18 has a lower end mounted on a horizontal pivot mounting 36 defining a horizontal axis extending across the bottom of the chute. Thus the mouth 17 is maintained at a fixed position relative to the accumulator as the carriage moves back and forth while the chute pivots between extreme positions indicated at dotted lines 37 and 38. The chute 18 has an upper end 39 attached the carriage 19 so that the upper end is carried back and forth between extreme positions 37 and 38. In order to accommodate the change of length necessary to maintain the lower end 17 at the fixed position and to move the upper end back and forth, the chute 18 is formed in an upper section 40 and a lower section 41 with one being slidable inside the other such that the length of the chute between the lower mouth 17 and the upper end 39 varies in length.

The chute is defined by two side walls 41 and 42 and by two end walls 43 and 44 thus fully enclosing the sheet material. Thus the chute 18 in its movement takes up and accommodates any forces from air moved by the chute rather than allowing the air to apply forces to the sheet material itself. This reduces the "sail" effect on the sheet material as it is transferred from the accumulator to the carriage.

Figure 3:
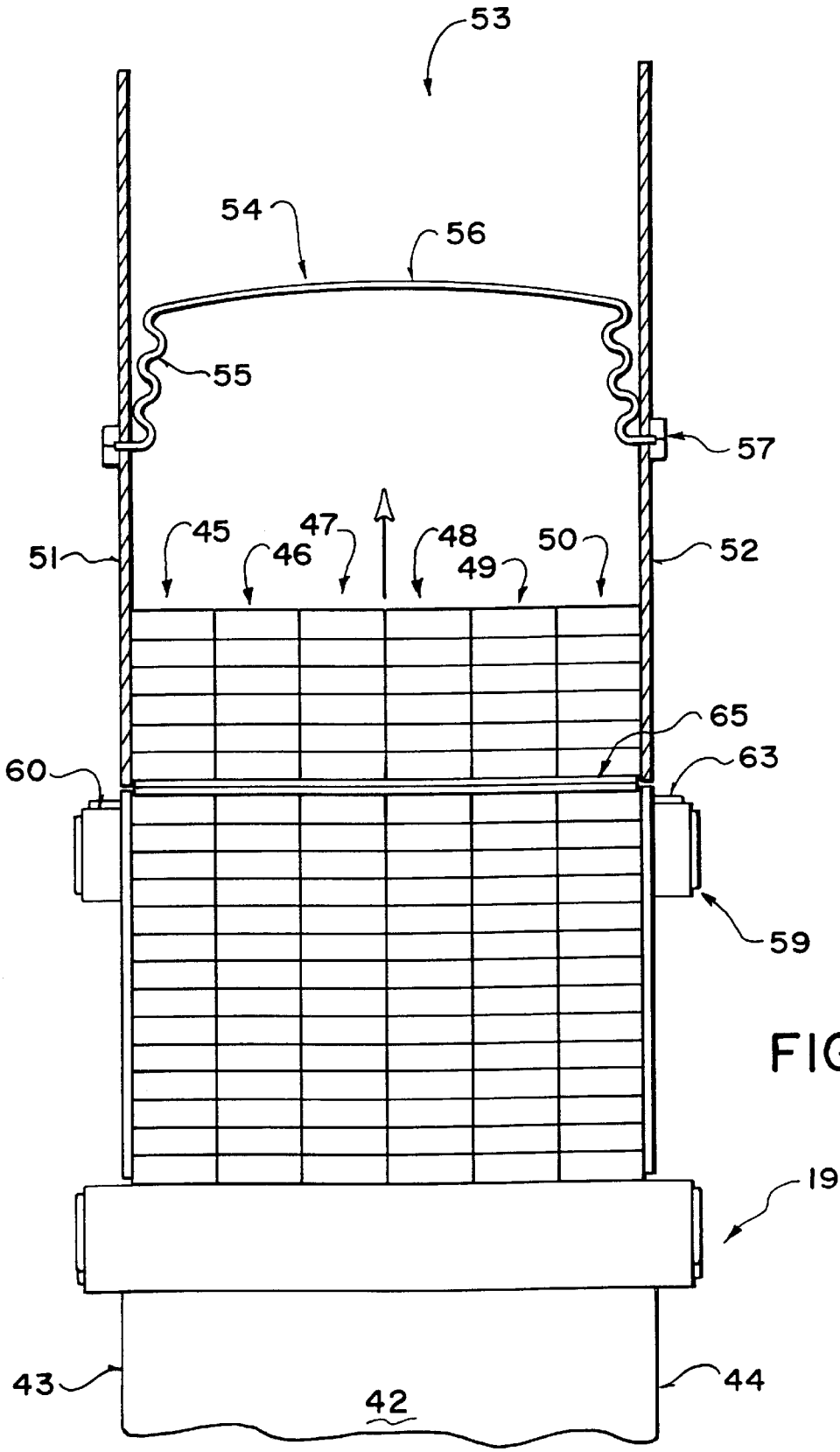
FIG. 3 is side elevational view along the lines 3—3 of FIG. 1.
Figure 4:
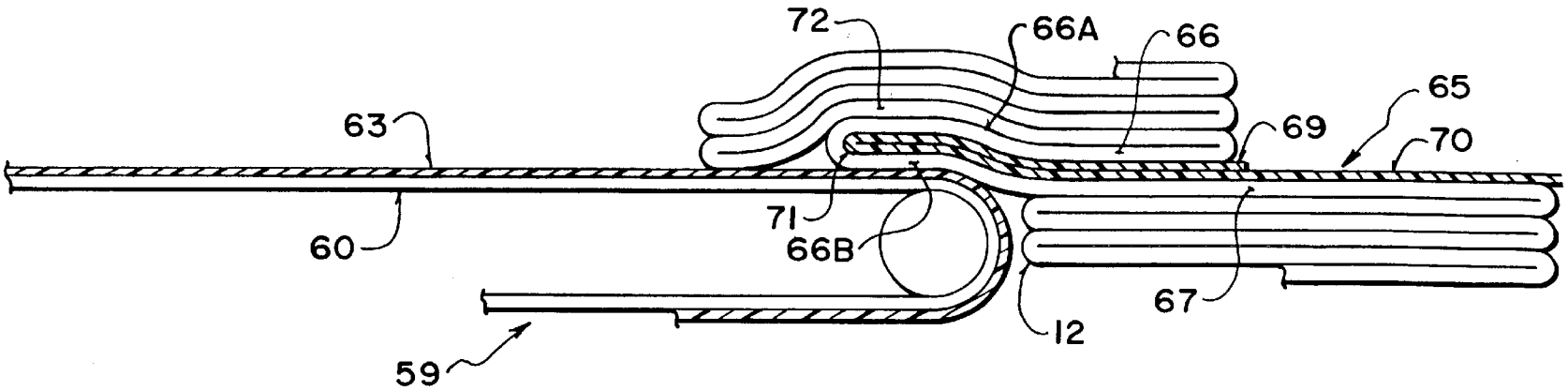
FIG. 4 is a cross-sectional view through the transfer area of FIG. 1 showing the movement of the stacks from the folding position to the compression station.

As shown in FIG. 3, the package contains six individual side by side stacks illustrated although it will be appreciated that the number of stacks can vary depending upon the width of the strips and the required width of the finished packaged structure. Thus the six stacks are generally indicated at 45, 46, 47, 48, 49 and 50. The stacks are parallel and side by side and each supports the next. However in order to maintain the stacks in vertical orientation, it is necessary to provide side walls 51 and 52 which engage the side edges of the end most stacks 45 and 50. The side walls can be complete covering the full length of the strip portions as shown in the upper part of the side walls as indicated at 51A or can be relatively short length side walls engaging only the ends of the stacks as indicated at 51B. However in all cases along substantially the full height of the structure, it is necessary to support and engage the outside edges of the stacks to maintain the stacks in proper vertical orientation.

The stacks are therefore built up by reciprocation of the carriage and supported on the carriage up to a position at the top of the side walls 51 thus providing a stack of a required height. The height can of course be varied depending upon requirements for the finished height of the package and depending upon the amount of compressibility of the sheet material.

Thus in FIG. 3, at a stack building station indicated at 53, the stacks are shown partly built from the carriage 19 up to an intermediate height. In order to contain the formed stacks, there is provided a containment enclosure 54 in the form of a flexible bag having side walls 55 and a top 56. The top of the bag can remain open or can be closed or partly closed leaving an open mouth at the bottom of the side wall 55 into which the stacks are pushed. The open mouth is supported by a suitable clamping assembly schematically indicated at 57 mounted on the side walls 51 and 52. Thus during the formation of the stacks, an operator inserts the bag into the building position 53 with a rectangular open mouth and a rectangular side wall defined and shaped to match the outside cross sectional shape of the package. This allows the building of the package to cause the stacks to slide upwardly along the inside surface of the side wall 51 and 52 and to engage the bag which is pressed against the side wall by the forming stacks thus pushing the bag so that its upper end 56 moves upwardly with the stacks while its open mouth is held at a fixed position by the clamping assembly 57.

The length of the side walls of the bag is selected so that it is equal to the finished compressed height of the package as discussed hereinafter. Thus the clamping assembly 57 is located at a position spaced downwardly from the top edge of the side walls by a distance equal to the length of the bag and thus the clamping assembly is located above the bottom of the stack.

When the stacks are built up to the required height thus filling the bag and expanding the bag to its full length, the mouth of the bag is released from the clamping assembly 57 allowing the built up stacks to be transferred from the building station 53 to a compression station generally indicated at 58.

The compression station 58 includes a support conveyor 59 having an upper run 60 on which the stacks are supported.

The upper run 60 of the conveyor 59 is located at a height spaced upwardly from the carriage 19. Thus, as transfer of the built up stacks from the position 53 onto the conveyor 59 occurs, this leaves a lower portion of the stacks below the upper run 60 which remain on the conveyor 19 thus providing a base for a next package structure to be formed with that base providing a weight onto the carriage sufficient to maintain the effective folding action as the carriage continues to reciprocate.

The movement of the upper portion of the stack above the conveyor 59 is therefore effected by a pusher plate 61 having a height equal to the height of the portion of the stack to be pushed thus acting to apply force to that portion to move it from the position 53 onto the conveyor 59. The pusher plate is actuated by a cylinder 62 or similar actuator. The pushing action of course also carries the bag surrounding the upper part of the stacks from the station 53 and the side walls 51, 52 into the compression station.

Figure 7:
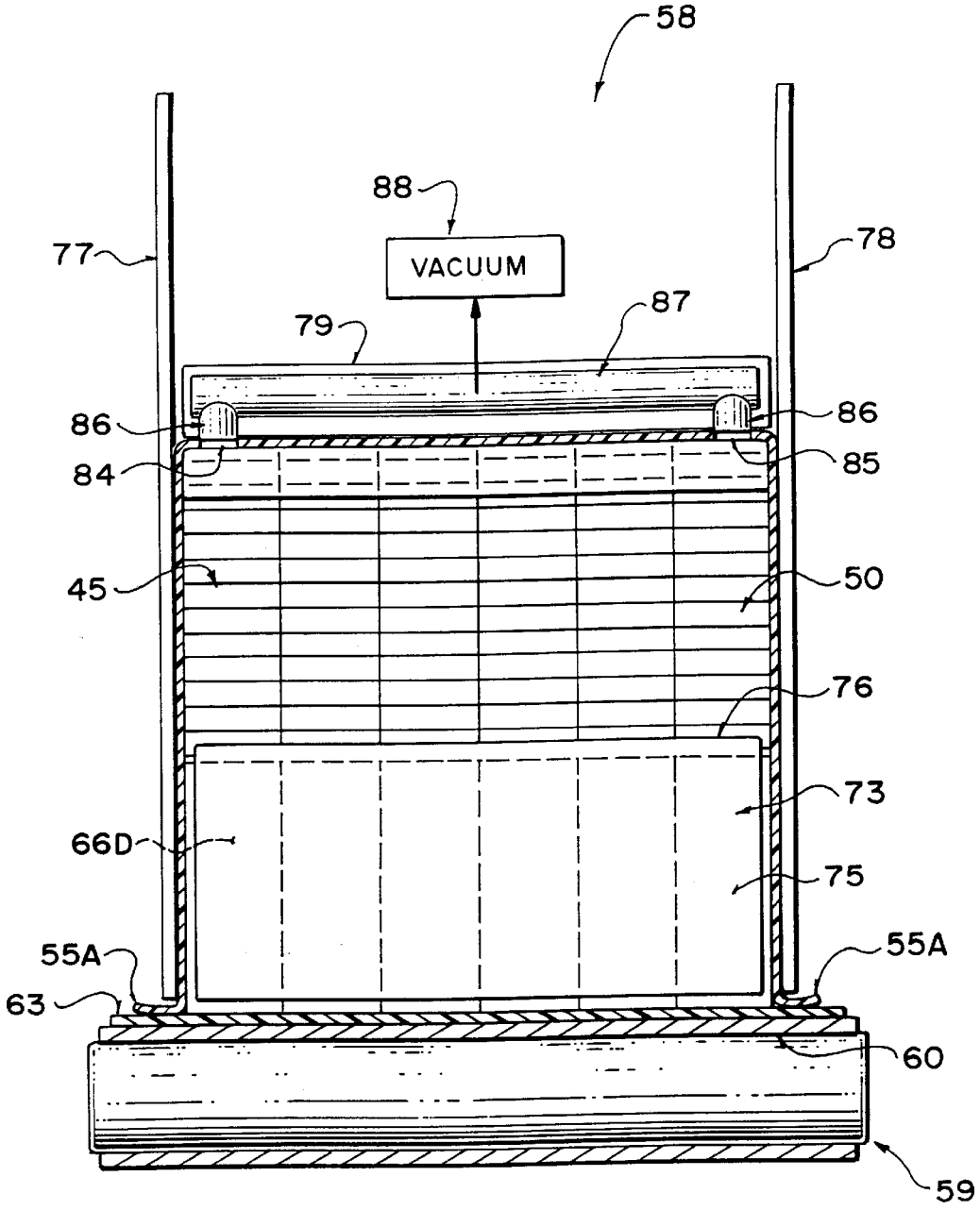
FIG. 7 is a view along the lines 7—7 of FIG. 1 showing the package after compression in the compression station.

The enclosure for containing the stacks after compression includes the bag 54 and also a base sheet 63 which is supplied on top of the upper run 60 of the conveyor 59. A supply roll 64 for the base sheet is mounted adjacent the conveyor and feeds the sheets so that it runs across the upper run 60 as a continuous strip onto which the stacks are pushed. The width of the sheet 63 as shown in FIGS. 3 and 7 is greater than the width of the package structure defined by the outer surfaces of the stacks 45 and 50.

In order to ensure effective separation of the upper part of the stacks above the conveyor 59, an insert member 65 is provided which engages between a lower most strip 66 of the upper part of the structure and an uppermost strip 67 of the lower part of the structure to remain in place on the carriage 19.

The separator member 65 is provided as a flexible plastics sheet which is fed into place during the formation of the stacks. Thus a feeding roller 68 is provided co-operating with the belt 25 which carries the plastic sheet and at a required position during the build of the stacks releases the flexible plastics sheet so that it is fed on the right hand side of the strips to underlie a series of the strips as the carriage moves from right to left in the direction of the arrow D and then is covered up by movement of the carriage in the opposite direction to take up the position, after build of further portions of the stack, as shown in FIG. 2. It will of course be appreciated that the position of insertion of the separator member 65 is selected during the build of the stacks so that the separator member reaches the height of the conveyor 59 when the top of the stacks reaches the required height.

Figure 5:
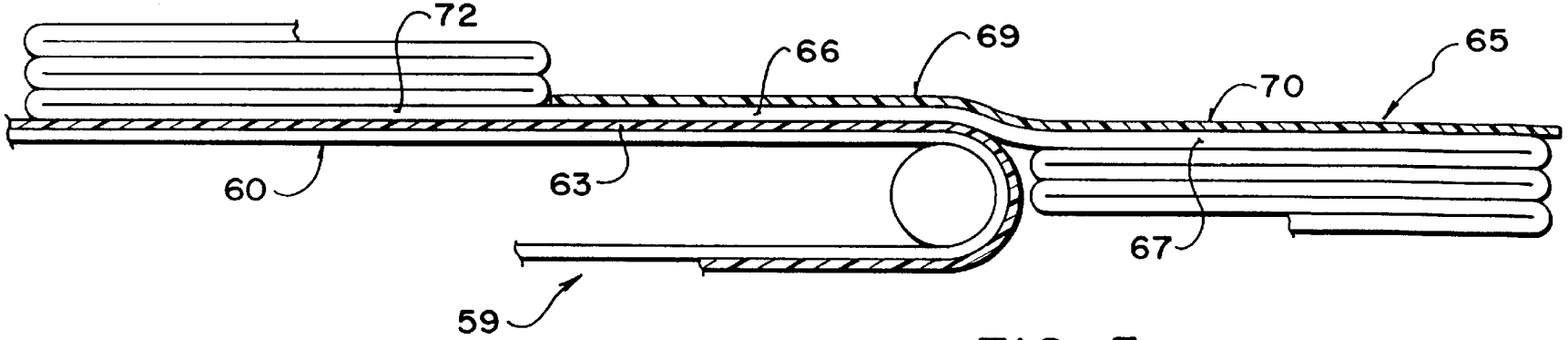
FIG. 5 is a cross-sectional view similar to that of FIG. 4 showing the stacks after movement to the compression station.

Preferably the separator member 65 comprises a folded sheet of plastics material thus defining two layers of the sheet 69 and 70 connected by a fold 71. Thus movement of the stacks can be seen by following the steps shown from FIG. 2 through FIG. 4 to FIG. 5. In this moving action, the strip 67 underlying the member 65 remains in fixed position. The strip 66 unrolls across the gap between the fold lines 12 of the stack and the conveyor 59. The strip 66 as it unrolls carries with it the upper sheet 69 of the member 65 so that that sheet unrolls also and slides across the underlying sheet 70. The use of plastics materials provides a low level of friction allowing a ready sliding action. As the unrolling and moving effect occurs, a next adjacent strip 72 overlying the strip 66 becomes the lower most strip and drops onto the sheet 63 on top of the upper run 60. The conveyor can be moved forwardly at this time to carry the lowermost strip 72 forwardly away from the position 63. Alternatively or additionally the sheet 63 can allow a sliding action. Thus the strip 66 is unrolled so that an upper portion 66A of that sheet gradually reduces in length and a lower portion 66B increases in length until a position shown in FIG. 5 is taken up in which the strip 66 is wholly unrolled and provides an interconnection from the lowermost strip 72 to the uppermost strip 67. In this position the sheets 69 and 70 of the member 65 are wholly unrolled and the sheets simply lie on top of the upper most strip 67 and the unrolled strip 66 and thus the member 65 can be removed as indicated by the arrow R in FIG. 6 for replacement at the feed device 68 of FIG. 2.

Figure 6:
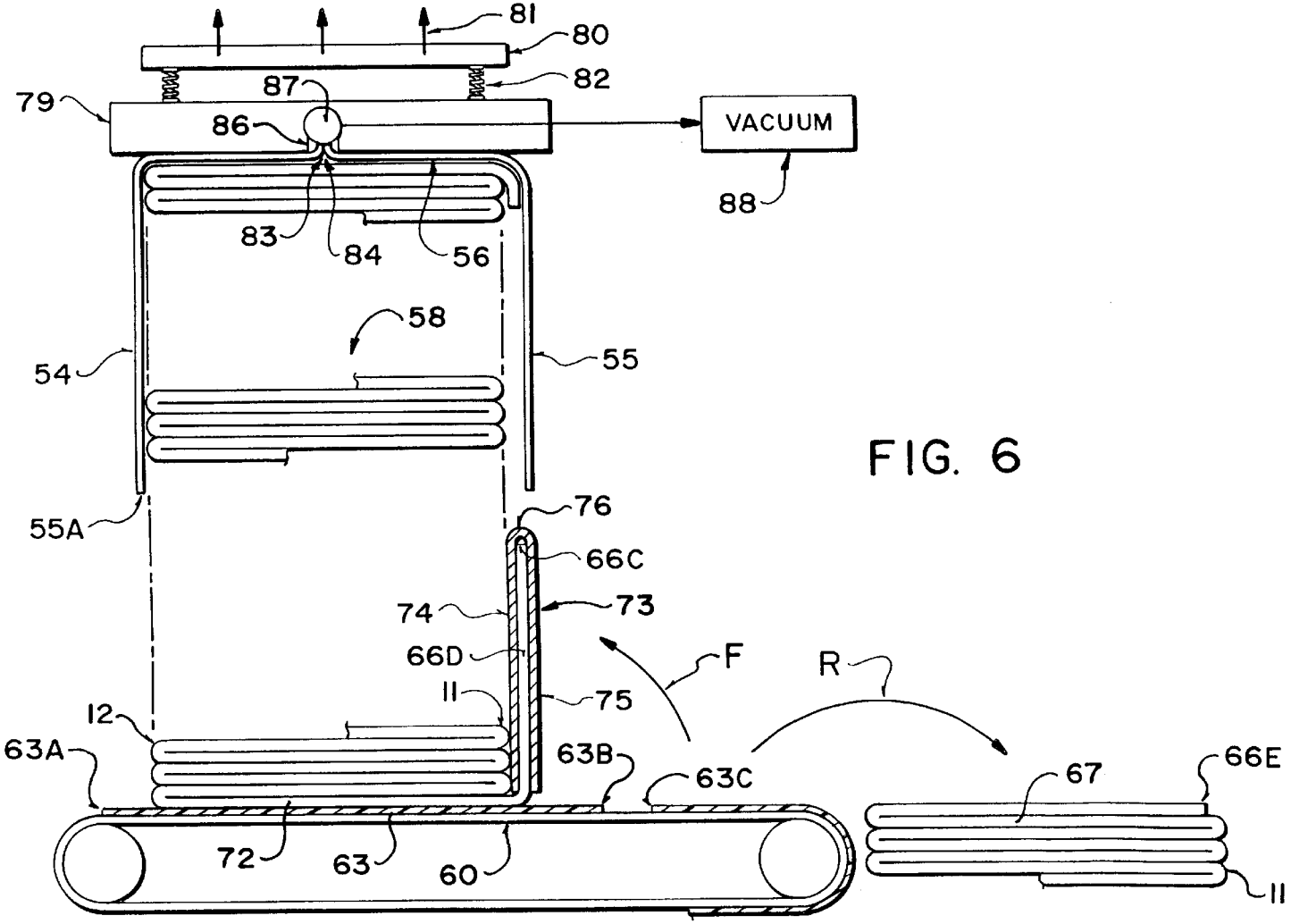
FIG. 6 is a cross-sectional view similar to that of FIG. 5 showing the compression station.

As shown in FIG. 6, after the transfer to the compression position 58 has occurred, the strip portion 66 is cut to define a first end 66C at the end of a portion 66D of that strip which is interconnected to the lowermost strip 72. An opposed end 66E is folded back onto the top strip portion 67 which remained in place so that the end 66E is arranged at or beyond the fold lines 11. A portion of the strip may be removed or unfolded from the top of the stacks in order to achieve this positioning of the ends 66C and 66E. The length of the strip portion 66D which is exposed beyond the end of the stack connected to the strip 72 is unlikely to be the full length of the strip 66 since it is undesirable to provide a tail portion of this long length. In general the length portion is preferred to be just sufficient for easy manipulation in the unfolding operation as discussed hereinafter.

Thus in a typical example, the compressed height of the package is likely to be of the order of three feet which is less than the length of the strip portions which are generally of the order of four feet. In such an example, the envelope can be arranged to be equal in height to the height of the package so that the envelope acts as a header plate for the end of the package.

The end 66E is shown in FIG. 6 as being located directly at the fold lines 11 so that it is accessible at the top of the package at the end of the fold lines 11. However the end can be arranged so that it hangs from the top of the package along the end of the package downwardly toward the bottom. This makes the end 66E even more accessible for later splicing as described hereinafter.

The portion 66D is enclosed within an envelope 73 which is formed by two sheets of a suitable protective material such as cardboard with an inner sheet 74 and an outer sheet 75 folded at an upper fold line 76 so that the row of strips each from a respective one of the stacks defined by the portion 66D are arranged in a row as best shown in FIG. 7. The envelope is folded, as indicated by the arrow F, upwardly to lie flat along the fold lines 11 of the stacks. In such an example, the envelope can be arranged to be equal in height to the height of the package so that the envelope acts as a header plate for the end of the package.

The sheet 63 as shown in FIG. 6 is cut so that it has edges 63A and 63B which extend beyond the fold lines 11 and 12. Thus each package has its own base sheet separated from the base sheet supply and a leading edge 63C of the next base sheet is provided for the next package to be formed and transferred as described before. At the compression station 58 as shown best in FIGS. 6 and 7 there is provided a pair of rigid side walls 77 and 78 which support the sides of the outermost stacks 45 and 50. The side walls 77 and 78 are separate from the side walls of the folding station so that they are movable to release the package when required, so that they have sufficient strength to accommodate the compression forces during the compression action and such that the position and structure of the walls allows the operator to access the envelope 73 and the heat sealing action as described hereinafter.

As shown in FIG. 6, the upper part of the package is surrounded by the bag 54 with the depending side walls 55 terminating at a lowermost edge 55A. This position can be located above the top of the envelope 73 so that the envelope can be folded up into position underneath the bottom of the bag. Alternatively when the cross-section of bag used is larger than the package, the bag is sufficiently loose to allow a higher envelope to be used so that its height is equal to the height of the compressed package. Thus it is necessary to feed this under the bottom edge of the bag. The tails at the top of the package defined by the end 66E, as they preferably hang down, thus hang down over the front of the envelope so that the envelope thus acts as a header plate protecting the top tails from crinkling under compression.

A compression weight 79 is provided having sufficient mass to apply a vertical load on the package structure to compress the stacks down to a required compression level. The amount of compression will vary depending upon the material to be packaged. The compression acts therefore to reduce the height of the package from a rest height to a compressed height. In general the material to be packaged is often of a fibrous nature so that compression is effected by expelling air from the individual strips thus reducing the thickness of each strip and thus the total height of the stacks. The amount of force applied is controlled by supporting the weight 79 on a carrier 80 which is supported on a suitable suspension system 81. A plurality of load cells 82 interconnect the carrier 80 and the weight 79 so that the actual force applied to the package can be calculated from the load cells and the suspension system 8 1 operated to maintain a required compressive force.

As the compression action is effected, the lower end of the bag 54 is wrapped around the envelope 73 and around a lower part of the stacks and pulled down until the bottom edge 55A reaches the sheet 63.

As previously described, the upper end 56 of the bag is wholly or partly closed by a heat sealed seam 83. This can be effected prior to application of the bag as shown in FIG. 3 or can be effected as part of the compression step at the station 58.

The heat seal 83 leaves open two openings 84 and 85 each adjacent a respective side of the package and these openings are engaged with duct sections 86 which connect to a main vacuum duct 87 connected to a vacuum source 88. As the compression action occurs, therefore, air is withdrawn from the package structure through the upper part of the bag to take up that air which is expelled from the package structure due to the compression. Of course some air also escapes underneath the bottom of the bag but this amount of escaping air will reduce as the bottom edge 55A is pulled down toward the base sheet 63A.

When the bottom edge 55A reaches the sheet 63, as shown in FIG. 8, the bottom edge is turned slightly outwardly to overlap with and contact those side edges of the sheet 63 which are exposed beyond the bottom edge of the bag. Thus the bottom edge 55A overlies the edges 63D and a heat sealer 89 is used to seal the out turned edge portions 555A to the base sheet around the periphery of the bag. The upper run of the conveyor acts as an anvil for the sealing action. The heat sealing action can be effected by various different techniques including heated air, heat sealing blades which are brought up mechanically to apply heat or a rotary device which moves around the bottom of the package to provide a peripheral seal. With the package thus sealed, further vacuum is applied form the vacuum source 88 through the openings 84 and 85 until the package is evacuated to a required negative pressure thus drawing the slightly oversize bag down onto the package. At this position the openings 84 and 85 are closed by heat sealing in a conventional manner so that the package is fully sealed. It will be noted therefore that the height of the bag is equal to the height of the compressed package and that there is no excess bag portion or excess material required thus reducing the quantity of packaging material. Furthermore in the event that a leak should occur through one of the seams, the package cannot expand back to or toward its rest height since it is maintained in the compressed condition by the taut bag. In the event of a leak, some bowing of the bag structure may occur but the package cannot dramatically expand as can occur in the situation where the bag has a length greater than the compressed length.

The completed compressed and sealed package is therefore shown in FIG. 9 where the ends 66E are shown at the same end of the package as the envelope 73 and are shown in the optional condition depending down the end of the package. The envelope 73 is free from compression or crinkling in a vertical direction even though the package material defined by the bag pulls the envelope tight against the end of the package structure and against the fold lines 11.

The bag is preferably formed of a laminate of an internal nylon material which provides high impermeability and high strength together with an outer layer of polyethylene which provides the necessary heat sealing effect The bag can be formed of a material having a total thickness of the order of 0.003 mil. The base sheet is formed from a similar material defining a nylon outer layer and a polyethylene inner or upper layer which is heat sealed to the outer layer on the bag. The base sheet can be formed of a thicker material of a thickness of the order of 0.003 to 0.010 mil to provide additional strength to accommodate engagement with forks of the fork lift truck or other lifting device.

In this condition the package can therefore be stored and transported while it is maintained in a clean environmentally sound condition.

Turning now to the unfolding arrangement shown in FIGS. 10 and 11, the package of FIG. 9 is thus transported to an unfold stand generally indicated at 90 of the type shown and described in the above prior applications and particularly the International application defined above. Thus the unfold stand provides an inclined bottom surface 91 which receives the bottom surfaces of the stacks 45 through 50 and an inclined side wall 92 which receives the side surface of the stack 50 and provides some support for that surface. Thus each of the stacks is inclined so that it leans onto the next adjacent stack with the stack 45 outermost and presented uppermost for initial unfolding. In this arrangement there is provided a header plate 93 which engages the top surfaces of all of the stacks and provides pressure thereto. The header plate is mounted on a guide 94 and can be driven along the guide 94 by a drive motor 95 or a cylinder in a sliding action so that it can be raised from the pressure position shown in FIG. 10 to a released position raised upwardly above the upper surface of the package shown in FIG. 11. The header plate can be locked at the pressure position and free sliding when unlocked so that it is moved by pressure from the package and lifted away from the package by the operator.

In an initial step in the unfolding action, therefore, the package in its compressed and wrapped condition is applied onto the unfold stand and the header plate 93 moved into position pressing against the upper surface of the stacks. The header plate is shaped to allow access to the top of the package around its full periphery to allow it to be cut open.

With the package thus constrained, a slit is formed in the bag around the top of the bag so that the top of the bag is in effect fully separated from a lower part of the bag thus releasing the vacuum while the package is maintained in compressed condition by the header plate. With the bag thus fully opened, the drive motor 95 is operated or the header plate unlocked to gradually release the pressure on the stack so that the stacks expand from the compressed condition back toward the initial rest condition. As shown in FIG. 11, the header plate is moved to a position spaced from the stacks allowing them to be fully exposed and the header plate can indeed be rotated fully from the area of the upper part of the stacks to allow the upper part to be fully exposed for unfolding.

Thus with the package structure released from compression as shown in FIG. 11, the remaining parts of the bag are cut away thus releasing the envelope 73 which is then removed releasing the tails 66D. A splicing jig 96 mounted on the guide 94 is moved into position along the fold lines 11 of the package structure. The splicing jig 96 includes a support bar over which the tails are laid and a clamping element movable into a clamping position for holding the tails 66D of the stacks (with the exception of the tail indicated at 66E of the stack 50 which is exposed for connection to a next adjacent package as the trailing end of this package structure).

The free ends 66E from the top end of the stacks, with the exception of the stack 45, are pulled down or moved into position by an operator from their initial position and twisted through 360° as indicated at 97 and engaged into the clamping arrangement of the splicing jig.

A moving splicing element 98 of the splicing jig is operated to scan across the adjacent ends 66D and 66E to provide a splicing action.

Splicing can be effected by various techniques including heat sealing and sewing. Sewn splices can be effected by the machine as described hereinafter.

The necessity for a twist and the arrangement of the ends is as described in the above identified application so that no further description will be added here.

With the splicing completed, the splicing jig is removed from a position which could interfere with the unfolding action and then the unfolding action is completed as illustrated schematically where each stack in turn from the stack 45 through to the stack 50 is unfolded and the strip material applied onto a conveyor 99.

It is preferable in this arrangement that the stacks be stored and located in a supply room separate from the end use machine on which the strip is to be employed. The strip can therefore be carried over a relatively long distance on the conveyor 99 from a supply room to a separate room where the end use machines are located.

A suitable sewing device for forming spliced ends in the manner shown is manufactured and sold by Elcu Sud Impianti SRL of Milano Italy known as the AAT2000 Butt End Sewing Machine or the TC105 Butt End Sewing Machine. This machine is commercially available and the details of it are available to one skilled in the art so that the details of the machine are not described herein and the details of the stitches formed by the machine or also not described herein.

However the above machine has not been utilized for absorbent products of the type with which the present invention is primarily concerned and is generally provided for attachment of fabrics.

In order to achieve an effective splice in the above situation it is necessary to ensure that the ends are square to the length of the strip and that the cutting action is effected along a line at right angles to the strip. It is also necessary to ensure that the stitches are arranged at a distance sufficient from the ends of the strip to provide sufficient material to give the strength required to accommodate the forces during handling of the strip. A distance of the order of 0.25 to 0.4 inches is generally acceptable.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A method of forming a package of a strip comprising:

providing a strip having a first side edge, a second side edge, a first surface and a second surface;

forming a plurality of stacks of the strip;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack, with the strip of each stack continuous through the stack between a bottom strip portion and a top strip portion;

and arranging the plurality of stacks side by side with the side edges of the strip portions of each stack adjacent the side edges of a next adjacent stack;

wherein the step of folding the strip in the stacks includes:

simultaneously supplying the strips side by side;

feeding the side by side strips through a guide slot in a carriage moveable parallel to the bottom surface of the stacks and moving the slot back and forth between the ends of the stacks so as to form the stacks on top of the carriage;

and providing guide surfaces engaging side edges of two outermost stacks of the package to maintain the stacks parallel and side by side;

wherein the material is carried from a supply to the slot through a guide chute which has one end which is pivotal at the supply and a second end which reciprocates with the guide slot and which has a length between the ends which changes in response to reciprocation of the slot.

2. A method of forming a package of a strip comprising:

providing a strip having a first side edge, a second side edge, a first surface and a second surface;

forming a plurality of stacks of the strip;

in each stack repeatedly folding the strip back and forth so that the stack, contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack, with the strip of each stack continuous through the stack between a bottom strip portion and a top strip portion;

arranging the plurality of stacks side by side with the side edges of the strip portions of each stack adjacent the side edges of a next adjacent stack;

wherein the step of folding the strip in the stacks includes:

simultaneously supplying the strips side by side;

feeding the side by side strips through a guide slot in a carriage moveable parallel to the bottom surface of the stacks and moving the slot back and forth between the ends of the stacks so as to form the stacks on top of the carriage;

providing a bag for receiving the side by side stacks, the bag having an open mouth and side walls;

and supporting the bag with the open mouth facing the carriage such that as the stacks are formed the stacks are forced into the open mouth to engage and be surrounded by the side walls of the bag to be received within the bag.

3. The method according to claim 2 including, after the stacks are formed and partly contained within the bag, compressing the stacks in a direction to reduce the height thereof to a position in which the stacks are wholly contained within the bag.

4. The method according to claim 3 wherein the bag has a length which is equal to the compressed height of the stacks.

5. The method according to claim 4 including providing a bottom sheet underlying the bottom surface of the stacks and including providing the bag with a closed upper end and an open bottom edge of the bag which is attached to the sheet to form a closed enclosure for the package.

6. The method according to claim 5 including evacuating the enclosure.

7. A method of forming a package of a compressible fibrous strip comprising:

providing a compressible fibrous strip having a first side edge a second side edge, a first surface and a second surface;

forming a plurality of stacks of the strip;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack, with the strip of each stack continuous through the stack between a bottom strip portion and a top strip portion;

arranging the plurality of stacks side by side with the side edges of the strip portions of each stack adjacent the side edges of a next adjacent stack;

compressing the stacks in a direction at right angles to the top and bottom surfaces so as to reduce the height of the stacks from a rest height to a compressed height;

and containing the compressed stacks in an enclosure so as to maintain the compression thereon, the enclosure comprising a bag having side walls with a length thereof substantially equal to the compressed height.

8. The method according to claim 7 wherein the enclosure comprises a bottom sheet underlying the bottom surface of the stacks and including providing the bag with a closed upper end and an open bottom edge of the bag which is attached to the sheet.

9. A method of forming a package of a strip comprising:

providing a strip having a first side edge, a second side edge, a first surface and a second surface;

forming a plurality of stacks of the strip;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack, with the strip of each stack continuous through the stack between a bottom strip portion and a top strip portion;

arranging the plurality of stacks side by side with the side edges of the strip portions of each stack adjacent the side edges of a next adjacent stack;

wherein the step of folding the strip in the stacks includes:

simultaneously supplying the strips side by side;

feeding the side by side strips through a guide slot in a carriage moveable parallel to the bottom surface of the stacks and moving the slot back and forth between the ends of the stacks so as to build the stacks on top of the carriage;

at a predetermined location during building of the stacks, feeding with the strips into the stacks a flexible slip sheet so to be folded with the strips at the predetermined location;

and when the stacks are built up to a required height above said location, pushing those portions of the stacks above said location toward one end of the stacks such that the portions above said location are separated from portions below said location by slipping of the strips across the slip sheet.

10. The method according to claim 9 wherein each end of the slip sheet is located at either end of the stack.

11. The method according to claim 9 wherein the slip sheet is folded at one end of the stack about a fold line transverse to the slip sheet to provide two overlying slip sheet portions.

12. A package comprising:

a compressible fibrous strip having a first side edge, a second side edge, a first surface and a second surface;

a plurality of stacks of the strip;

in each stack the strip being folded repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions of each stack being arranged to form a plurality of first fold lines at one end of the stack and a plurality of second told lines at an opposed end of the stack;

the strip portions of each stack being arranged such that the first surface of each strip portion lies directly in contact with the first surface of one next adjacent strip portion and such that the second surface of each strip portion lies directly in contact with the second surface of the other next adjacent strip portion;

the strip portions of each stack being arranged with the first side edges thereof lying directly on top of and aligned with the first side edges of others of the strip portions of the stack and with the second side edges thereof lying directly on top of and aligned with the second side edges of others of the strip portions of the stack;

the strip portions of each stack being arranged with the first and second surfaces thereof generally parallel to a top surface and a bottom surface of the stack, with the strip of each stack continuous through the stack between a bottom strip portion and a top strip portion;

the plurality of stacks being arranged side by side with the side edges of the strip portions of each stack adjacent the side edges of a next adjacent stack;

the stacks being compressed in a direction at right angles to the surfaces of the strip portions such that the height of the stacks is reduced from a rest height to a compressed height;

the package being wrapped and maintained compressed by a packaging enclosure including a bag having a side wall substantially equal in height to the compressed height and therefore less than the rest height.

13. The package according to claim 12 wherein each of the stacks includes a splice tail portion extending from the bottom strip portion and extending beyond an end of the stack so as to accessible for splicing, all of the splice tail portions being arranged at the same end of the stacks, the splice tail portions being engaged into an envelope lying flat against said end of the stacks and contained within the bag.

14. The package according to claim 12 wherein the enclosure comprises a bottom sheet underlying the bottom surface of the stacks and wherein the bag includes a closed upper end and an open bottom edge of the bag which is attached to the sheet.

15. The package according to claim 14 wherein the bottom sheet includes side edges thereof which are turned upwardly and heat sealed to bottom edge portions of the bag.

16. The package according to claim 15 wherein the bag and the sheet each comprise a laminate defined by a first layer of an air impervious plastics material and a second layer of a heat sealable plastics material.

* * * * *